US007226372B2

(12) United States Patent
Flanigan

(10) Patent No.: US 7,226,372 B2
(45) Date of Patent: Jun. 5, 2007

(54) BATTING TEE

(76) Inventor: George R. Flanigan, 6300 Church Rd., Unit 318A, Hanover Park, IL (US) 60133

( * ) Notice: Subject to any disclaimer, the term of this patent is extended or adjusted under 35 U.S.C. 154(b) by 0 days.

(21) Appl. No.: 11/072,865

(22) Filed: Mar. 3, 2005

(65) Prior Publication Data

US 2006/0199672 A1 Sep. 7, 2006

(51) Int. Cl.
*A63B 69/40* (2006.01)

(52) U.S. Cl. ..... 473/417; 473/431; 473/451; 124/16

(58) Field of Classification Search ..... 473/417, 473/431, 451, 387; 124/16, 17, 37
See application file for complete search history.

(56) References Cited

U.S. PATENT DOCUMENTS 2,976,041 A * 3/1961 White ..... 473/417
3,474,711 A * 10/1969 Breslow et al. ..... 124/16
3,545,752 A * 12/1970 Hill et al. ..... 124/16
4,365,814 A * 12/1982 Robinson ..... 273/317
4,969,660 A * 11/1990 Spak ..... 280/646
4,993,708 A * 2/1991 Prossor et al. ..... 473/417
6,099,417 A * 8/2000 Brown et al. ..... 473/417
6,296,581 B1 * 10/2001 Sever ..... 473/422
6,443,859 B1 * 9/2002 Markin ..... 473/451

* cited by examiner

*Primary Examiner*—Mitra Aryanpour
(74) *Attorney, Agent, or Firm*—Fuzail & Associates; Kalim Fuzail

(57) ABSTRACT

The present invention provides a batting tee comprising a hollow tubular vertical stand having a first end through which at least one ball can be loaded inside said tubular vertical stand, and a second end, a means for pushing the ball upwardly just above the first end, the pushing means housed within said hollow tubular stand, and a horizontal base plate affixed to the second end portion.

13 Claims, 1 Drawing Sheet

BATTING TEE

FIELD OF THE INVENTION

The present invention generally relates to devices for baseball or softball practice hitting and, more particularly, is concerned with a portable batting tee.

BACKGROUND OF THE INVENTION

Baseball is a favorite American pastime and training begins at a very young age. The most difficult aspect of the game is hitting the baseball so that it is projected to a desired distance and direction. To perfect this skill, people young and old will partake in batting practice. Batting practice is often conducted in large open fields or batting cages. People travel to these practice areas with all of their equipment including baseballs, bats, helmets, gloves and most importantly baseball tees. Carrying all of this equipment to a car, unloading it onto a field of play, setting it up, and then re-loading it back into the car after practice is tiring and cumbersome. To ease this burden, some of the equipment is placed into a large bags, and other pieces of equipment are carried or dragged onto the field. The bags are heavy and awkward to carry.

During the set up process the batting tee is assembled and placed into position. Once the batting tee is set up, people load one baseball at a time on top of the tee before taking a swing at it with their baseball bat. Afterwards, they must place another ball on top of the tee before taking another swing. This process is repeated throughout the practice session. This is very distracting and takes away time and energy from improving a person's batting skill.

Many batting tees are known including, for example, the tee disclosed in U.S. Pat. No. 4,136,869. The tee comprises a base and an upstanding column carried by the base and having means for supporting a ball on such column. The column and base are made of a yieldable resilient material and are constructed to enable the column to be struck by a ball bat and easily knocked down with the column and bat remaining intact and once knocked down enabling the base and the major portion of the column to be easily flattened upon applying compressive forces thereagainst to thereby assure a person falling thereagainst will be free of injury.

Another such device is disclosed in U.S. Pat. No. 4,176,838 which provides, for example, a batting baseball tee comprised of a self-righting, semi-spherical weighted bottom portion with an axially upstanding post removably fixed thereto, terminating at its upper end with an inverted conical helical spring attached thereto for the reception of a ball forming a batting target.

U.S. Pat. No. 4,227,691 provides, for example, a planar base adapted to rest on the ground, and having a plurality of holes therein and being a representation of a baseball home plate, an elongate, length-adjustable, telescoping member, such member including an elongate pipe being externally threaded at one end thereof, such one end of the pipe being extendable through any one of the holes in the base; and a disc having an internally threaded central hole for receipt of one end of the pipe for removably connecting the telescoping member to any one of the holes in the base, the member supporting a ball above the selected hole in the base.

U.S. Pat. No. 4,383,686 provides, for example, a batting tee comprising a base including an upper and lower base member held in substantially parallel spaced relation relative to each other by a first set of spacers disposed therebetween wherein the upper and lower base member each comprises a first and second base element normally disposed in coplanar relation relative to each other, a second set of spacers attached to the lower surface of the lower base member to support the batting tee above the ground, a substantially vertical adjustable tee member including an outer interconnecting element having an upper and lower tee element extending from opposite ends thereof, a flexible ball receiving element is coupled to the upper portion of the upper tee element, a plurality of corresponding apertures comprising a predetermined pattern are formed in the upper and lower base members to selectively receive the lower tee element thereinto vary the ball hitting position relative to the batting tee wherein the predetermined pattern comprises at least two pair of substantially parallel rows of apertures to permit the batter to select one of at least three batting positions relative to the batting tee.

Several other U.S. patents disclose a variety of batting tee designs. While they provide interesting designs there leaves much room for improvement. It is desirable to have a batting tee which requires no assembly. It is also desirable to have an easy way to transport equipment such as baseballs, bats etc. onto a playing field at one time. It is yet another desirable feature to have a baseball tee which does not require re-loading of a baseball or softball after every hit.

SUMMARY OF THE INVENTION

The present invention provides a batting tee comprising a hollow tubular vertical stand having a first and a second end, and a horizontal base plate affixed to the second end of the tubular stand, wherein the base plate further comprises at least two wheels attached thereto, a collapsible handle and an upwardly extending wall about its perimeter to form a basket suitable for holding a plurality of balls and bats.

In one embodiment, the tubular stand is a tube within a sleeve, the tube telescopically extendable from within the sleeve to increase or decrease the height of the stand.

In another embodiment, at least one ball such as, for example but limited thereto, a baseball or softball can be loaded within the stand of the batting tee. A pushing means is also housed within the stand just underneath the ball for pushing the ball upwardly just above the first end of the stand. The pushing means can be, for example but not limited thereto, a spring, a hydraulically or electromagnetically driven piston.

BRIEF DESCRIPTION OF THE DRAWINGS

In the following detailed description, reference will be made to the attached drawings in which.

DETAILED DESCRIPTION OF THE INVENTION

Figure 1:
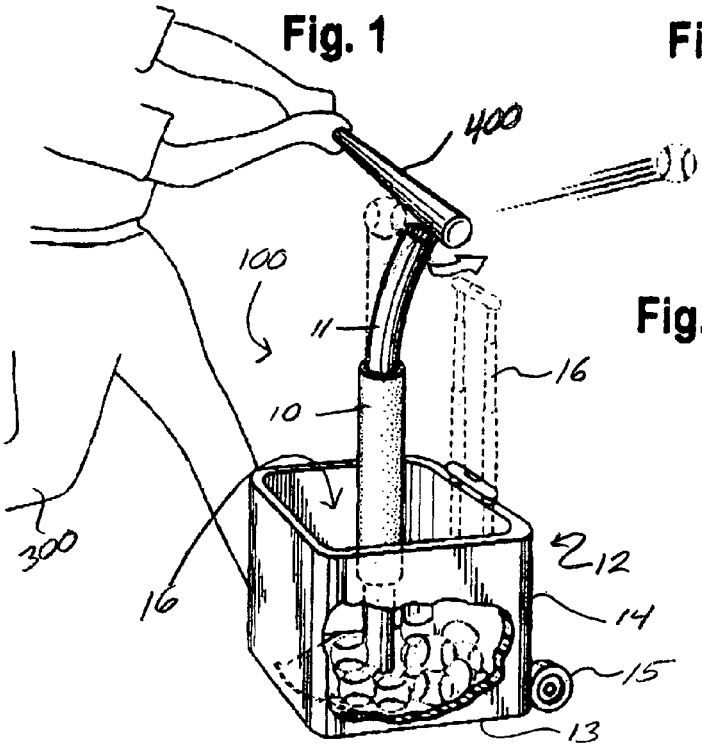
FIG. 1 is a perspective view of a batting tee of the present invention.

Turning now to the drawings, and particularly FIG. 1, what is shown is a batting tee 100 of the present invention. Batting tee 100 is comprised of a tubular vertical stand 10 affixed to a base 12. Vertical stand 10 can be constructed from resilient materials to withstand the force of impact produced upon contact with a baseball bat 400. Such materials are well known in the art and include plastic, rubber or any other resilient material which has a degree of flexibility and is not hard and brittle. In one embodiment, vertical stand 10 can be adjusted in height to accommodate people of varying heights. Tube 11 can fit within vertical stand 10, and telescopically extend upwards to increase or downwards to decrease the height of the tee. Tube 11 can fit inside stand 10 snuggly so that friction holds tube 11 in place when extended. Alternatively, a fastener such as, for example, a screw, snap or clamp, can be use to hold tube 11 in place when extended so that it does not drop back down into stand 10.

Base 12 is comprised of a horizontal base plate 13 and an upwardly extending wall 14 running about its entire perimeter to form a basket 16. Baseballs, softballs, bats and other equipment can be stored and transported in basket 16. Wheels 15 as well as a collapsible handle 16 can be attached to base 12.

A person 300 can upwardly extend handle 16 and roll the batting tee 100 using its wheels 15 to a spot in a field to practice batting. Once a desired destination is reached handle 16 can be collapsed downwardly, and the vertical stand 10 can be adjusted to the appropriate height. A baseball or softball can be removed from the basket 16 and placed atop the tee. A person 300 can then swing at the ball using a bat 400.

Figure 2:
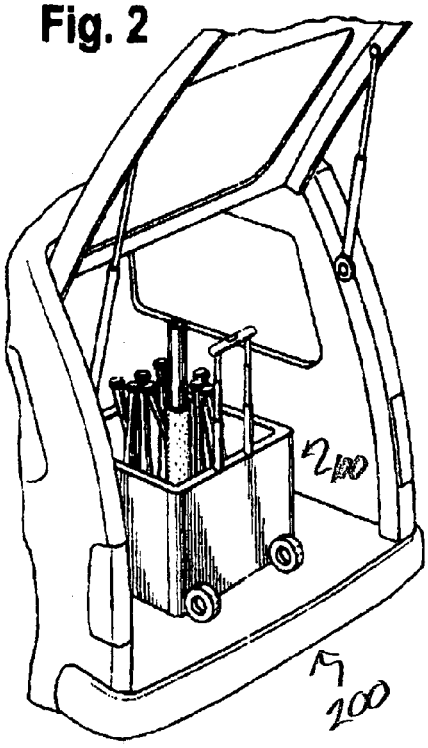
FIG. 2 is a perspective view of the batting tee loaded into the cargo hold of a minivan.
Figure 5:
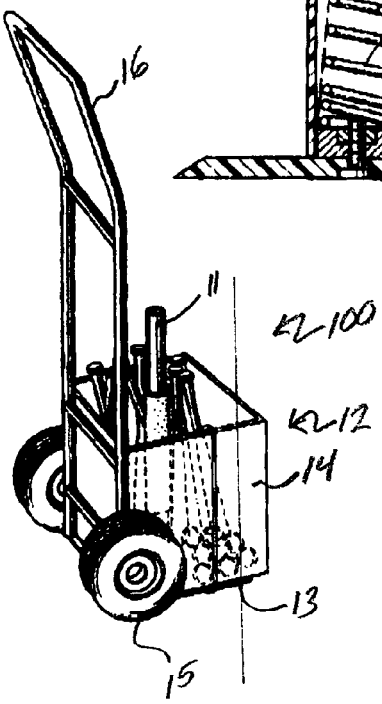
FIG. 5 is a perspective view of the batting tee apparatus with handle extended and basket loaded with extra baseballs and bats.

At the end of a practice session the balls, bats and other equipment can be loaded into basket 16, the handle 16 extended upwards and the tee rolled away from the playing field as shown in FIG. 5. The compact tee 100 can be placed into a trunk or cargo hold 200 of a minivan as shown in FIG. 2.

Figure 4:
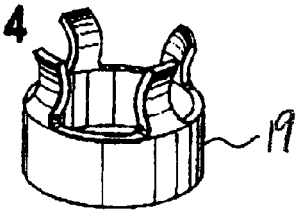
FIG. 4 is a perspective view of the controlling device.
Figure 3:
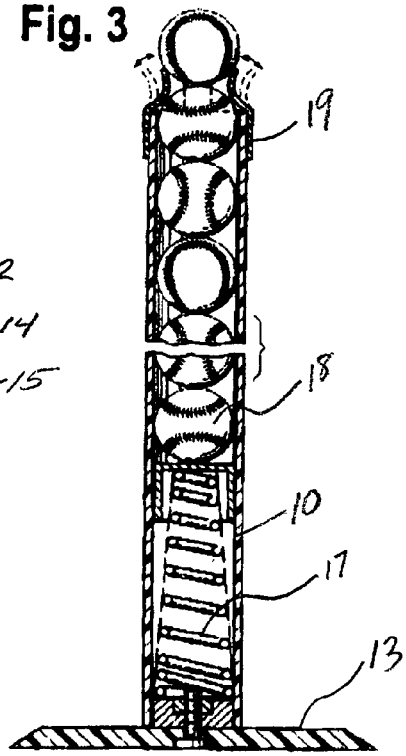
FIG. 3 is a cross-sectional view of the batting tee.

In one embodiment, vertical stand 10 is a hollow tube in which at least one baseball or softball, and more preferably a plurality of baseballs or softballs, can be loaded and advanced upwardly by a pushing means 17 as shown in FIG. 3. Pushing means 17 can be a spring which lays just under the ball or balls in the stand. When the balls are loaded into stand 10, the spring is compressed down. The relaxed state of spring 17 is in its extended form rather than compressed. Therefore, compressed spring 17 exerts an upward force pushing the ball or balls just above it up and out of stand 10 and atop the tee. A regulator 19 can optionally be affixed to the top portion of vertical stand 10 as shown in FIGS. 3 and 4 so that only one ball exits the stand at a time. Another function of the regulator 19 is to ensure that the ball remains stationary atop the tee. Also, regulator 19 prevents the advanced ball from dropping back down into the vertical stand 19. While one form of the regulator is shown it is known to one skilled in the art that many types of controller devices can be used to ensure only one ball is advanced at a time. Devices such as a solenoid switch can be used such that when the solenoid is activated, the switch opens to let out one ball.

In another embodiment, pushing means 17 can be a hydraulically driven piston. For example, a pump can inject fluid under the piston to drive it upwards. By moving upwards, the piston pushes a ball resting above it up and out on the stand 10 to a position just atop the tee.

In yet another embodiment, pushing means 17 can be an electromagnetically driven piston using a solenoid. When the solenoid is activated, a piston is driven upwards pushing a ball resting above it up and out of stand 10 and atop the tee.

While particular embodiments of the present invention have been illustrated and described, it would be obvious to those skilled in the art that various other changes and modifications can be made without departing from the spirit and scope of the invention. It is therefore intended to cover in the appended claims all such changes and modifications that are within the scope of this invention.

What is claimed is:

1. A batting tee comprising:

a hollow tubular vertical stand having a first end through which a plurality of balls can be loaded inside said tubular vertical stand and a second end;

a means for pushing the balls upwardly just above the first end, the pushing means housed within said hollow tubular stand;

a horizontal base plate affixed to the second end portion; and a regulator affixed to the first end above the vertical stand, the regulator permitting only one ball to exit the tubular stand at a time, and wherein the regulator acts as a cup for holding the released ball.

2. The batting tee of claim 1, wherein the pushing means is a spring.

3. The batting tee of claim 1, the base further comprising at least two wheels.

4. The batting tee of claim 3, the base further comprising a collapsible handle.

5. The batting tee of claim 1, the base further comprising an upwardly extending wall about its perimeter to form a basket suitable for holding a plurality of balls and bats.

6. The batting tee of claim 1, wherein the length of the tubular stand can be increased or decreased.

7. The batting tee of claim 1, wherein the ball is a baseball or softball.

8. The batting tee of claim 1, wherein the second end of the vertical stand is removably affixed to the base plate.

9. A batting tee comprising:

a hollow tubular vertical stand having a first end through which a plurality of balls can be loaded inside said tubular vertical stand and a second end;

a means for nushing the balls upwardly just above the first end, the pushing means housed within said hollow tubular stand:

a horizontal base plate affixed to the second end oft be tubular stand; and a regulator affixed to the first end above the vertical stand, the regulator permitting only one ball to exit the tubular stand at a time, and wherein the regulator acts as a cup for holding the released ball;

wherein the base plate further comprises at least two wheels attached thereto, a collapsible handle and an upwardly extending wail about its perimeter to form a basket suitable for holding a plurality of balls and bats.

10. The batting tee of claim 9, wherein the tubular stand is comprised of a tube within a sleeve, the tube telescopically extendable from within the sleeve to increase or decrease the height of the stand.

11. The batting tee of claim 9, wherein at least one ball can be loaded within the hollow stand of the batting tee, and the batting tee further comprises a means for pushing the loaded ball upwardly just above the first end, the pushing means housed within said hollow tubular stand and underneath the loaded ball.

12. The batting tee of claim 11, wherein the pushing means is a spring.

13. A batting tee comprising:

a hollow tubular vertical stand having a first end through which a plurality of balls can be loaded inside said tubular vertical stand and a second end;

a means for pushing the balls upwardly just above the first end, the pushing means housed within said hollow tubular stand;

a regulator affixed to the first end above the vertical stand, the regulator permitting only one ball to exit the tubular stand at a time, and wherein the regulator acts as a cup for holding the released ball; and a horizontal base plate affixed to the second end of the tubular stand;

wherein the base plate further comprises at least two wheels attached thereto, a collapsible handle and an upwardly extending wall about its perimeter to form a basket suitable for holding a plurality of balls and bats, and wherein the pushing means is a spring.

* * * * *